US009134686B2

(12) United States Patent
Yoshikawa et al.

(10) Patent No.: US 9,134,686 B2
(45) Date of Patent: Sep. 15, 2015

(54) IMAGE FORMING APPARATUS PROVIDED WITH MOVABLE CONVEYING UNIT

(71) Applicants: Masanari Yoshikawa, Nagoya (JP); Shougo Sato, Seto (JP)

(72) Inventors: Masanari Yoshikawa, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/140,772

(22) Filed: Dec. 26, 2013

(65) Prior Publication Data

US 2014/0186082 A1 Jul. 3, 2014

(30) Foreign Application Priority Data

Dec. 27, 2012 (JP) ..... 2012-285894

(51) Int. Cl.
*G03G 21/10* (2006.01)
*G03G 15/16* (2006.01)

(52) U.S. Cl.
CPC ..... *G03G 21/105* (2013.01); *G03G 15/161* (2013.01); *G03G 2215/0132* (2013.01)

(58) Field of Classification Search
CPC . G03G 21/10; G03G 21/105; G03G 21/1619; G03G 15/161; G03G 2215/1647; G03G 2221/1603
USPC ..... 399/358, 101, 110, 123, 125
See application file for complete search history.

(56) References Cited

U.S. PATENT DOCUMENTS

| | | | | |
|---|---|---|---|---|
| 7,221,887 | B2 * | 5/2007 | Kimura et al. | 399/101 |
| 2011/0076056 | A1 * | 3/2011 | Sato | 399/120 |
| 2012/0070186 | A1 * | 3/2012 | Kikuchi et al. | 399/110 |
| 2012/0328325 | A1 * | 12/2012 | Sato | 399/110 |
| 2013/0051837 | A1 * | 2/2013 | Yoshikawa | 399/101 |
| 2013/0136488 | A1 * | 5/2013 | Yoshikawa | 399/101 |
| 2014/0119772 | A1 * | 5/2014 | Sato | 399/110 |

FOREIGN PATENT DOCUMENTS

| | | | |
|---|---|---|---|
| JP | H03-118589 | A | 5/1991 |
| JP | 2010-008472 | A | 1/2010 |
| JP | 2010-101990 | A * | 5/2010 |

OTHER PUBLICATIONS

Machine translation of JP 2010-008472 (published on Jan. 14, 2010) printed on Jan. 27, 2015.*

* cited by examiner

*Primary Examiner* — Sophia S Chen
(74) *Attorney, Agent, or Firm* — Banner & Witcoff, Ltd.

(57) ABSTRACT

An image forming apparatus includes: a belt cleaning unit; a waste toner container; a conveying unit; and a support member. The cleaning unit collects waste toner adhered to a belt. The container stores the waste toner collected by the cleaning unit. The conveying unit conveys the waste toner from the cleaning unit to the container. The support member moves between an internal position inside the main casing and an external position outside the main casing. The support member in the internal position moves between a contact position where the photosensitive body contacts the belt and a separated position where the photosensitive body separates from the belt. The conveying unit moves along with the support member moving between the contact position and the separated position. The conveying unit is uncoupled from the container while the support member moves from the internal position to the external position.

19 Claims, 5 Drawing Sheets

IMAGE FORMING APPARATUS PROVIDED WITH MOVABLE CONVEYING UNIT

CROSS REFERENCE TO RELATED APPLICATION

This application claims priority from Japanese Patent Application No. 2012-285894 filed Dec. 27, 2012. The entire content of the priority application is incorporated herein by reference.

TECHNICAL FIELD

The present invention relates to an image forming apparatus using an electrophotographic method.

BACKGROUND

One electrophotographic image forming apparatus known in the art includes a plurality of process cartridges, each of which supports a photosensitive drum for a corresponding toner color, e.g., for one of the colors yellow, magenta, cyan, and black.

One such image forming apparatus that has been proposed includes an apparatus body; an image-forming unit that integrally retains a plurality of process cartridges and that is detachably mounted in the apparatus body; a sheet-conveying belt disposed beneath the image-forming unit and in confrontation with the plurality of process cartridges; a belt-cleaning device that removes toner when toner becomes deposited on the sheet-conveying belt; a waste toner collection box that is provided at the image-forming unit and that collects waste toner removed from the sheet-conveying belt by the belt-cleaning device; and a belt-waste-toner conveying tube that is fixed to the apparatus body and that conveys waste toner removed by the belt-cleaning device to the waste toner collection box.

In an image forming apparatus having this conventional structure, the waste toner collection box can be uncoupled from the belt-waste-toner conveying tube. The waste toner collection box is uncoupled from the belt-waste-toner conveying tube when the image-forming unit is pulled out of the apparatus body, and is coupled to the belt-waste-toner conveying tube when the image-forming unit is mounted in the apparatus body.

SUMMARY

However, when mounting the image-forming unit into the apparatus body of the conventional image forming apparatus described above, the image-forming unit first moves horizontally, and subsequently moves diagonally downward. Through this operation, the photosensitive drums exposed in the bottom of the image-forming unit are placed into contact with the sheet-conveying belt.

In other words, when being mounted in the apparatus body, the image-forming unit is moved first in a horizontal direction and then in a direction diagonally downward in order that the photosensitive drums are placed into contact with the sheet-conveying belt. Therefore, the waste toner collection box is coupled to the belt-waste-toner conveying tube when the image-forming unit is moving diagonally downward.

Hence, in the operation for mounting the image-forming unit into the apparatus body of the image forming apparatus, the photosensitive drums are prevented from sliding over the sheet-conveying belt, and the waste toner collection box is coupled to the belt-waste-toner conveying tube when the image-forming unit is moved diagonally downward. Accordingly, the relative positions of the waste toner collection box and the belt-waste-toner conveying tube must be set with great precision in order that the two components are reliably coupled.

Dimensional tolerance of components and other factors makes it difficult to ensure the relative positioning precision of the waste toner collection box and the belt-waste-toner conveying tube when the image-forming unit is mounted in the apparatus body and can pose difficulties in reliably conveying waste toner from the belt-cleaning device to the waste toner collection box. This configuration may also lead to damage to the parts being coupled when the image-forming unit is mounted in the apparatus body.

In view of the foregoing, it is an object of the present invention to provide an image forming apparatus capable of preventing a plurality of photosensitive members from sliding over a conveying belt when a support member supporting the photosensitive members is moved between an internal position and an external position, and capable of ensuring that waste toner collected by a belt cleaning unit can be conveyed reliably from the belt cleaning unit to a waste toner container.

In order to attain the above and other objects, the present invention provides an image forming apparatus configured to form an image on a photosensitive body by using toner accommodated in a cartridge. The image forming apparatus includes: a main casing; a belt unit; a waste toner container; a conveying unit; and a support member. The belt unit includes a belt, and a belt cleaning unit configured to collect waste toner adhered to the belt. The waste toner container is configured to store the waste toner collected by the belt cleaning unit. The conveying unit is configured to be coupled to the waste toner container and to convey the waste toner collected by the belt cleaning unit from the belt cleaning unit to the waste toner container. The support member is configured to support the cartridge and the waste toner container. The support member is configured to move between an internal position where the support member is inside the main casing and an external position where the support member is at least partly outside the main casing. The support member in the internal position is configured to move between a contact position where the photosensitive body is in contact with the belt and a separated position where the photosensitive body is spaced apart from the belt. The conveying unit is configured to be moved along with the movement of the support member between the contact position and the separated position. The conveying unit is configured to be uncoupled from the waste toner container while the support member moves from the internal position to the external position.

DETAILED DESCRIPTION

1. Overall Structure of Printer

Next, an overall structure of a printer as an image forming apparatus according to one embodiment of the present invention will be described with reference to FIGS. 1 through 5B.

Figure 1:
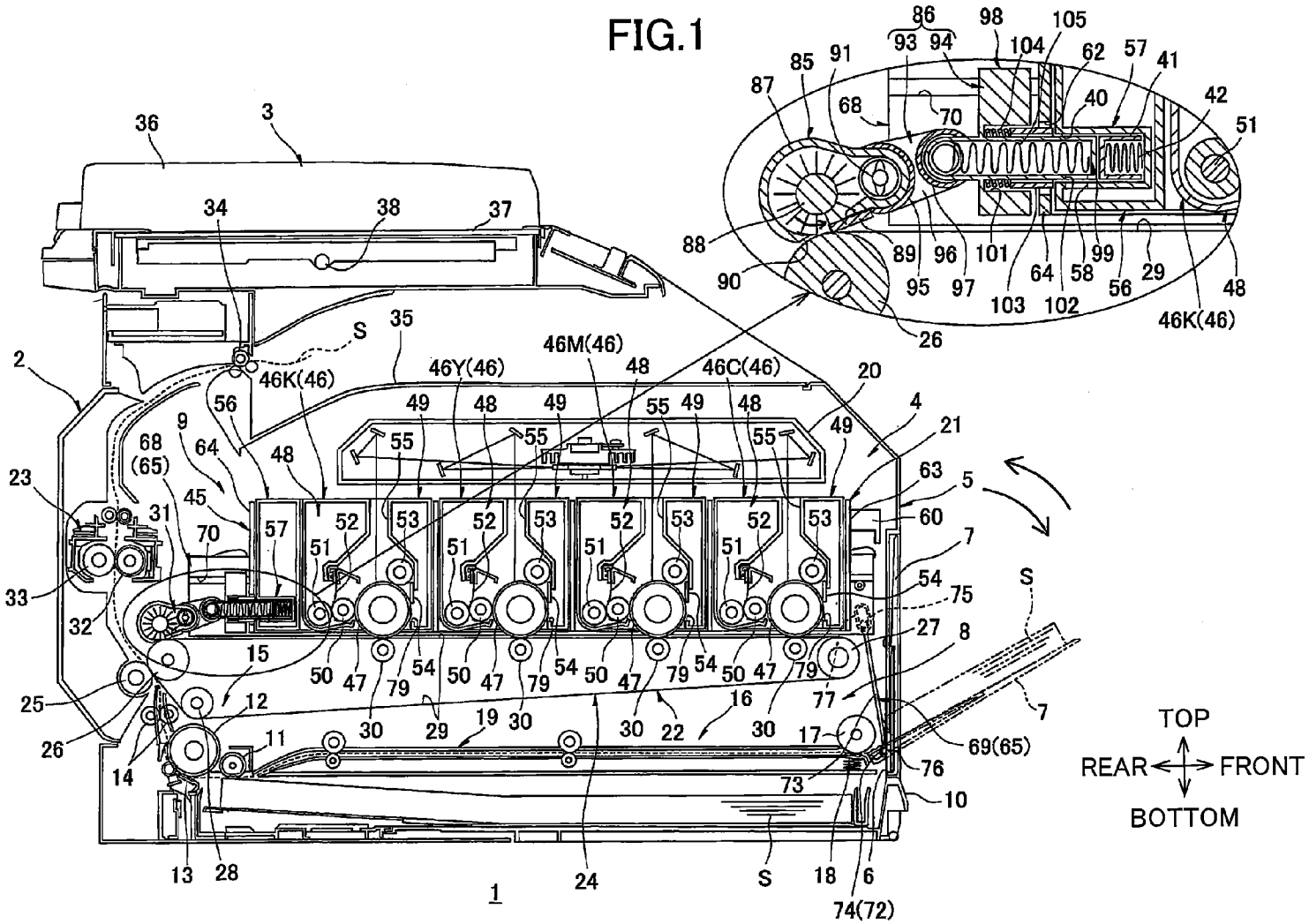
FIG. 1 is a left cross-sectional view of a printer according to one embodiment of the present invention when a front cover is in a closed position and a process unit is in an internal position.

As shown in FIG. 1, the printer 1 is a horizontal tandem-type intermediate transfer color printer. The printer 1 is a multifunction peripheral that is integrally provided with a main casing 2, and a flatbed scanner 3 provided above the main casing 2 for scanning image data of an original.

(1) Main Casing

The main casing 2 is formed in a box-like shape that is generally rectangular in a side view. An opening 4 is formed in one side wall of the main casing 2 to allow the passage of a process unit 21 (described later).

In the following description, the terms "upward", "downward", "upper", "lower", "above", "below", "beneath", "right", "left", "front", "rear" and the like will be used assuming that the printer 1 is disposed in an orientation in which it is intended to be used. That is, directions used in the following description in relation to the printer 1 will reference the state of the printer 1 when the printer 1 is resting on a flat surface.

More specifically, as indicated by the direction arrows in FIG. 1, the side of the printer 1 in which the opening 4 is formed (the right side in FIG. 1) will be referred to as the "front side," and the opposite side (the left side in FIG. 1) will be referred to as the "rear side." Further, left and right sides of the printer 1 will be based on the perspective of the user facing the front side of the printer 1. Thus, the near side of the printer 1 in FIG. 1 will be considered the "left side," and the far side will be considered the "right side." Further, the front-rear direction and the left-right direction in the following description are horizontal directions, while the top-bottom direction refers to the vertical direction.

A front cover 5 is provided on a front end portion of the main casing 2. The front cover 5 has a generally flat plate shape that is elongated vertically. The front cover 5 can be pivotally moved about its lower end between a closed position shown in FIG. 1 for covering the opening 4, and an open position shown in FIG. 2 for exposing the opening 4. The following description will refer to the front cover 5 in its closed position shown in FIG. 1.

A manual-feed opening 6 is formed in the front cover 5. Specifically, the manual-feed opening 6 penetrates a lower portion of the front cover 5 in a front-rear direction. The dimension of the manual-feed opening 6 in a left-right direction is sufficiently large to allow passage of sheets S of paper.

A manual-feed tray 7 is provided on the front side of the front cover 5. The manual-feed tray 7 has a generally flat plate shape that is elongated vertically. The manual-feed tray 7 can be pivotally moved about its lower end between a closed position and an open position. In the closed position, the manual-feed tray 7 is aligned with the vertical and covers the manual-feed opening 6. In the open position, the manual-feed tray 7 is pivotally moved clockwise in a left side view (in FIG. 1) about 45 degrees from the closed position and exposes the manual-feed opening 6. In FIG. 1, the manual-feed tray 7 is depicted in solid lines in the closed position and in broken lines in the open position.

When the manual-feed tray 7 is moved to the open position, as depicted in the broken lines in FIG. 1, a stack of sheets S can be supported on a top surface of the manual-feed tray 7. When moved to the open position, a lower edge of the manual-feed tray 7 pivotally moves through the manual-feed opening 6 into the main casing 2 to a position obliquely below and forward of a manual feeding roller 17 (described later).

Within the main casing 2, the printer 1 is also provided with a sheet-feeding unit 8 for feeding sheets S of paper to be printed, and an image-forming unit 9 for forming images on the sheets S fed by the sheet-feeding unit 8.

(2) Sheet-Feeding Unit

The sheet-feeding unit 8 includes a paper tray 10 detachably mounted in a bottom section of the main casing 2, a first feeding unit 15 disposed above a rear end portion of the paper tray 10, and a second feeding unit 16 disposed frontward of the first feeding unit 15.

The paper tray 10 is a box-like tray with an open top and serves to accommodate sheets S therein.

The first feeding unit 15 includes a pickup roller 11 disposed above the rear end portion of the paper tray 10, a feeding roller 12 disposed rearward of the pickup roller 11, a feeding pad 13 disposed below and in confrontation with the feeding roller 12, and a pair of registration rollers 14 disposed obliquely above and rearward of the feeding roller 12.

The second feeding unit 16 includes the manual feeding roller 17 disposed above a front end portion of the paper tray 10 and rearward of the manual-feed opening 6, a separating pad 18 disposed below and in confrontation with the manual feeding roller 17, and a manual-feed conveying path 19 extending from the manual feeding roller 17 to the pickup roller 11 in the front-rear direction.

(2-1) Feeding Operation

The pickup roller 11 rotates to supply sheets S accommodated in the paper tray 10 to a position between the feeding roller 12 and the feeding pad 13, whereby the feeding roller 12 rotates to feed the sheets S while the feeding pad 13 ensures that only one sheet is fed at a time. When a sheet S is fed to the registration rollers 14, the registration rollers 14 rotate and supply the sheet S at a prescribed timing to a position between an intermediate transfer belt 29 (described later) and a secondary transfer roller 25 (described later).

Similarly, sheets S of paper stacked on the manual-feed tray 7 when the manual-feed tray 7 is in the open position are moved down the slope of the manual-feed tray 7 through the manual-feed opening 6 and are supplied to a position between the manual feeding roller 17 and the separating pad 18. The rotating manual feeding roller 17 and the separating pad 18 cooperate to separate and convey the sheets S one sheet at a time onto the manual-feed conveying path 19. Various rollers provided along the manual-feed conveying path 19 convey the sheets S to the pickup roller 11. As in the above description, each sheet S that arrives at the pickup roller 11 is supplied to a position between the intermediate transfer belt 29 (described later) and the secondary transfer roller 25 (described later) through the rotations of the pickup roller 11, the feeding roller 12, and the pair of registration rollers 14.

(3) Image-Forming Unit

The image-forming unit 9 includes a scanning unit 20, the process unit 21, a transfer unit 22, and a fixing unit 23.

(3-1) Scanning Unit

The scanning unit 20 is disposed in a top section of the main casing 2. Based on image data, the scanning unit 20 emits four laser beams toward respective photosensitive drums 47 (described later), the paths of which are depicted by solid lines in FIG. 1, thereby exposing the surfaces of the photosensitive drums 47.

(3-2) Process Unit

The process unit 21 is disposed beneath the scanning unit 20. As will be described later in greater detail, the process unit 21 can be moved between an internal position shown in FIGS. 1 and 2 and an external position shown in FIG. 3. In the internal position, the process unit 21 is mounted in the main casing 2. In the external position, the process unit 21 is withdrawn to an outside of the main casing 2. The following description will reference the process unit 21 in the internal position shown in FIG. 1.

The process unit 21 includes a plurality of process cartridges 46 (four in the embodiment), and a drawer frame 45 for retaining the process cartridges 46.

The drawer frame 45 has a frame-like configuration that is generally rectangular in a plan view and open on the top and the bottom.

The plurality of process cartridges 46 are detachably mounted in the drawer frame 45. Four of the process cartridges 46 are provided for the respective colors black, yellow, magenta, and cyan. Thus, the process cartridges 46 include a black process cartridge 46K, a yellow process cartridge 46Y, a magenta process cartridge 46M, and a cyan process cartridge 46C arranged juxtaposed with each other in this order from the rear side toward the front side.

Each process cartridge 46 includes a photosensitive drum 47, a toner supply unit 48 for supplying toner to the photosensitive drum 47, a toner recovery unit 49 for collecting toner from the photosensitive drum 47, and a charging roller 53 for charging the photosensitive drum 47. Hence, the process unit 21 effectively supports the plurality of photosensitive drums 47.

The photosensitive drum 47 is generally cylindrical in shape and is oriented with its axis aligned in the left-right direction. The photosensitive drum 47 is rotatably disposed in a bottom portion of the process cartridge 46 with its bottom surface exposed through the bottom portion. The plurality of photosensitive drums 47 are arranged, within the main casing 2, juxtaposed with each other and spaced at intervals in the front-rear direction.

The toner supply unit 48 constitutes a rear portion of the process cartridge 46. The toner supply unit 48 has a box-like shape that extends vertically. In its lower portion, the toner supply unit 48 is provided with a developing roller 50, a supply roller 51, and a thickness-regulating blade 52.

The developing roller 50 has a general cylindrical shape with its axis aligned in the left-right direction. The developing roller 50 is rotatably provided in a bottom portion of the toner supply unit 48 so that its peripheral surface is exposed on the front side. The developing roller 50 contacts the photosensitive drum 47 on the rear side thereof.

The supply roller 51 has a general cylindrical shape with its axis aligned in the left-right direction. The supply roller 51 is rotatably provided on the rear side of the developing roller 50 and contacts the developing roller 50 on the rear side thereof.

The thickness-regulating blade 52 has a generally flat plate shape that extends vertically. The thickness-regulating blade 52 is fixed to the toner supply unit 48 so that its bottom end contacts the developing roller 50 on the rear side thereof.

The toner supply unit 48 has a portion above the supply roller 51 that serves to accommodate toner therein.

The toner recovery unit 49 constitutes a front portion of the process cartridge 46. The toner recovery unit 49 has a box-like shape and extends vertically. An opening 79 is formed in a portion of the toner recovery unit 49 that confronts the photosensitive drum 47 in the front-rear direction. The toner recovery unit 49 is provided with a drum-cleaning blade 54.

The drum-cleaning blade 54 has a generally flat plate shape and extends vertically. The drum-cleaning blade 54 is fixed to an upper peripheral edge defining the opening 79 so that its bottom end contacts a circumferential surface of the photosensitive drum 47 on the front side thereof.

As will be described later in detail, the drum-cleaning blade 54 serves to scrape off residual toner from the circumferential surface of the photosensitive drum 47. Residual toner scraped off from the photosensitive drum 47 by the drum-cleaning blade 54 is collected in the toner recovery unit 49.

The charging roller 53 has a general cylindrical shape with its axis aligned in the left-right direction. The charging roller 53 is rotatably provided in the process cartridge 46 on the front side of the toner recovery unit 49. The charging roller 53 contacts the photosensitive drum 47 on the upper front side thereof.

A transmission hole 55 is formed in an upper end of the process cartridge 46, passing between the toner supply unit 48 and the toner recovery unit 49 and facing the photosensitive drum 47. The transmission hole 55 allows passage of a laser beam emitted from the scanning unit 20.

(3-3) Transfer Unit

The transfer unit 22 is disposed beneath the process unit 21. The transfer unit 22 includes a belt unit 24, and the secondary transfer roller 25.

The belt unit 24 is oriented in the front-rear direction so as to confront each of the plurality of photosensitive drums 47 from below. The belt unit 24 includes a drive roller 26, a first follow roller 27, a second follow roller 28, the intermediate transfer belt 29, a plurality of primary transfer rollers 30 (four in the embodiment), and a belt cleaner 31.

The drive roller 26 and the first follow roller 27 are arranged in confrontation with each other and spaced apart from each other in the front-rear direction. The second follow roller 28 is disposed below and forward from the drive roller 26 and arranged spaced apart from the drive roller 26.

The intermediate transfer belt 29 is looped around the drive roller 26, the first follow roller 27, and the second follow roller 28, with an upper portion of the intermediate transfer belt 29 disposed below the plurality of photosensitive drums 47 so as to confront the plurality of photosensitive drums 47 vertically.

When the drive roller 26 is driven to rotate, the first follow roller 27 and the second follow roller 28 follow this rotation as the intermediate transfer belt 29 circulates so that its upper portion in contact with the plurality of photosensitive drums 47 moves forward.

Each of the plurality of primary transfer rollers 30 is disposed beneath the corresponding photosensitive drum 47 and confronts the corresponding photosensitive drum 47 vertically with the upper portion of the intermediate transfer belt 29 interposed therebetween.

The belt cleaner 31 is disposed above a rear end portion of the intermediate transfer belt 29 and rearward of the process unit 21. As will be described later in greater detail, the belt cleaner 31 recovers (collects) waste toner that has become deposited on (adhered to) the intermediate transfer belt 29.

The secondary transfer roller 25 is provided on the lower rear side of the drive roller 26 and confronts the drive roller 26 with the intermediate transfer belt 29 interposed therebetween.

(3-4) Fixing Unit

The fixing unit 23 is disposed above the secondary transfer roller 25. The fixing unit 23 includes a heating roller 32, and a pressure roller 33 that contacts the heating roller 32 on the rear side thereof and applies pressure thereto.

(4) Image-Forming Operation (4-1) Developing Operation

Toner in each toner supply unit 48 is supplied onto the corresponding supply roller 51, and the rotating supply roller 51 in turn supplies the toner onto the corresponding developing roller 50, while the toner is tribocharged between the supply roller 51 and the developing roller 50. The thickness-regulating blade 52 regulates the thickness of toner supplied to the developing roller 50 as the developing roller 50 rotates, maintaining the toner carried on the surface of the developing roller 50 at a thin uniform thickness.

In the meantime, the charging roller 53 applies a uniform charge to the surface of the corresponding photosensitive drum 47. Subsequently, the photosensitive drum 47 is exposed by the scanning unit 20, whereby an electrostatic latent image is formed on the surface of the photosensitive drum 47 based on image data.

The toner carried on the developing roller 50 is then supplied to the electrostatic latent image formed on the photosensitive drum 47 to produce a toner image thereon.

(4-2) Transferring and Fixing Operations

A primary transfer is performed by sequentially transferring toner images carried on the surfaces of the photosensitive drums 47 onto the upper portion of the intermediate transfer belt 29 as the upper portion of the intermediate transfer belt 29 moves forward. The primary transfer forms a color image on the intermediate transfer belt 29. As the intermediate transfer belt 29 passes through a position opposing the secondary transfer roller 25, the color image formed on the intermediate transfer belt 29 is transferred in a secondary transfer onto a sheet S supplied from the sheet-feeding unit 8.

The color image transferred onto the sheet S is fixed to the sheet S by heat and pressure as the sheet S passes between the heating roller 32 and the pressure roller 33.

(4-3) Discharging Operation

Discharge rollers 34 receive the sheet S after the color image has been fixed to the sheet S in the fixing unit 23, and discharge the sheet S onto a discharge tray 35 formed on a top surface of the main casing 2.

(5) Flatbed Scanner

The flatbed scanner 3 is disposed above the discharge tray 35. The flatbed scanner 3 includes a cover 36, a glass surface 37, and a CCD sensor 38. After an original is placed between the cover 36 and the glass surface 37, the flatbed scanner 3 scans image data from the original by sliding the CCD sensor 38 over the original. Subsequently, the image-forming unit 9 can form an image on a sheet S, as described above, based on the image data scanned from the original.

2. Detailed Description of Main Casing (1) Interlocking Mechanism

Figure 2:
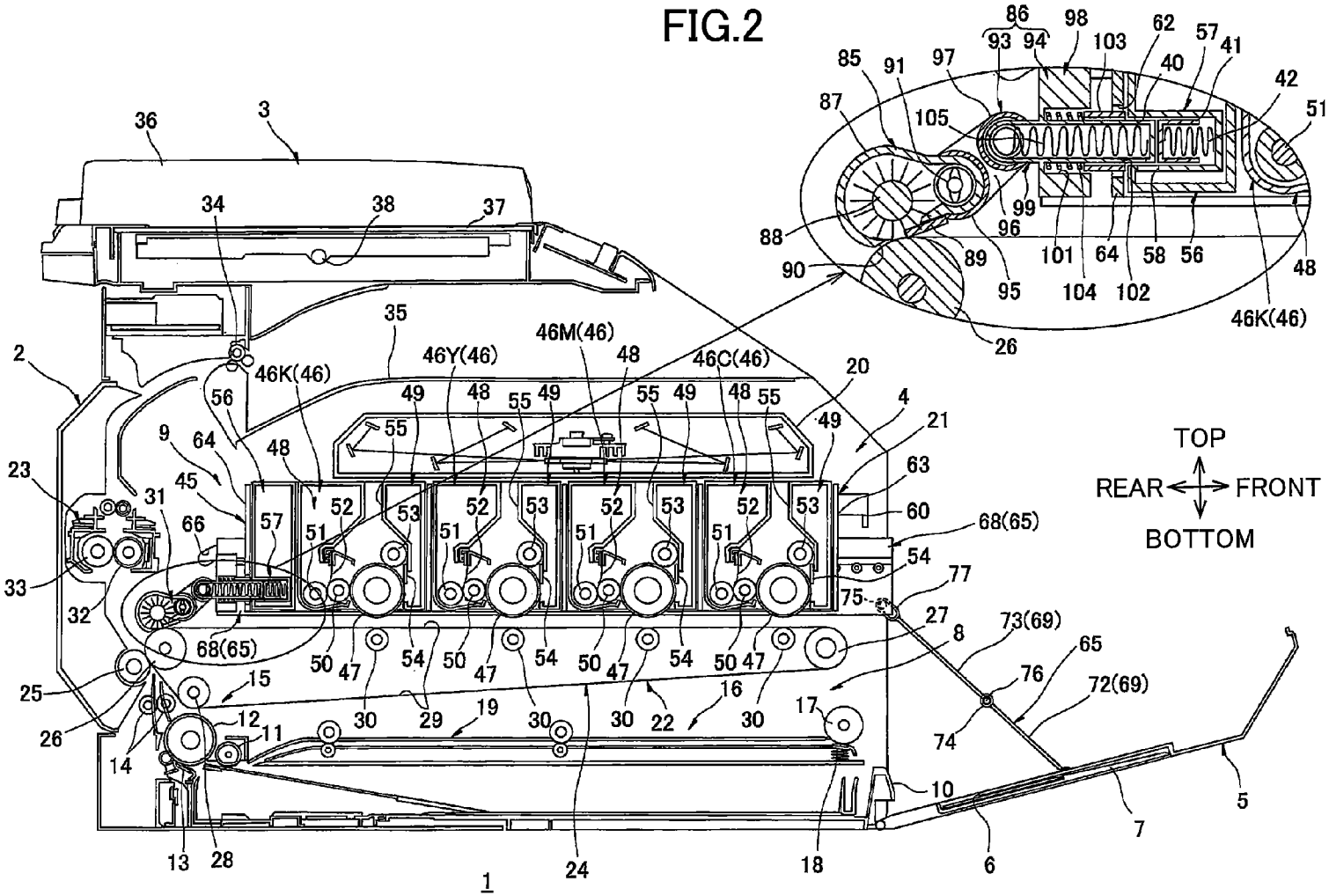
FIG. 2 is a left cross-sectional view of the printer in FIG. 1 when the front cover is in an open position and the process unit is in the internal position.
Figure 3:
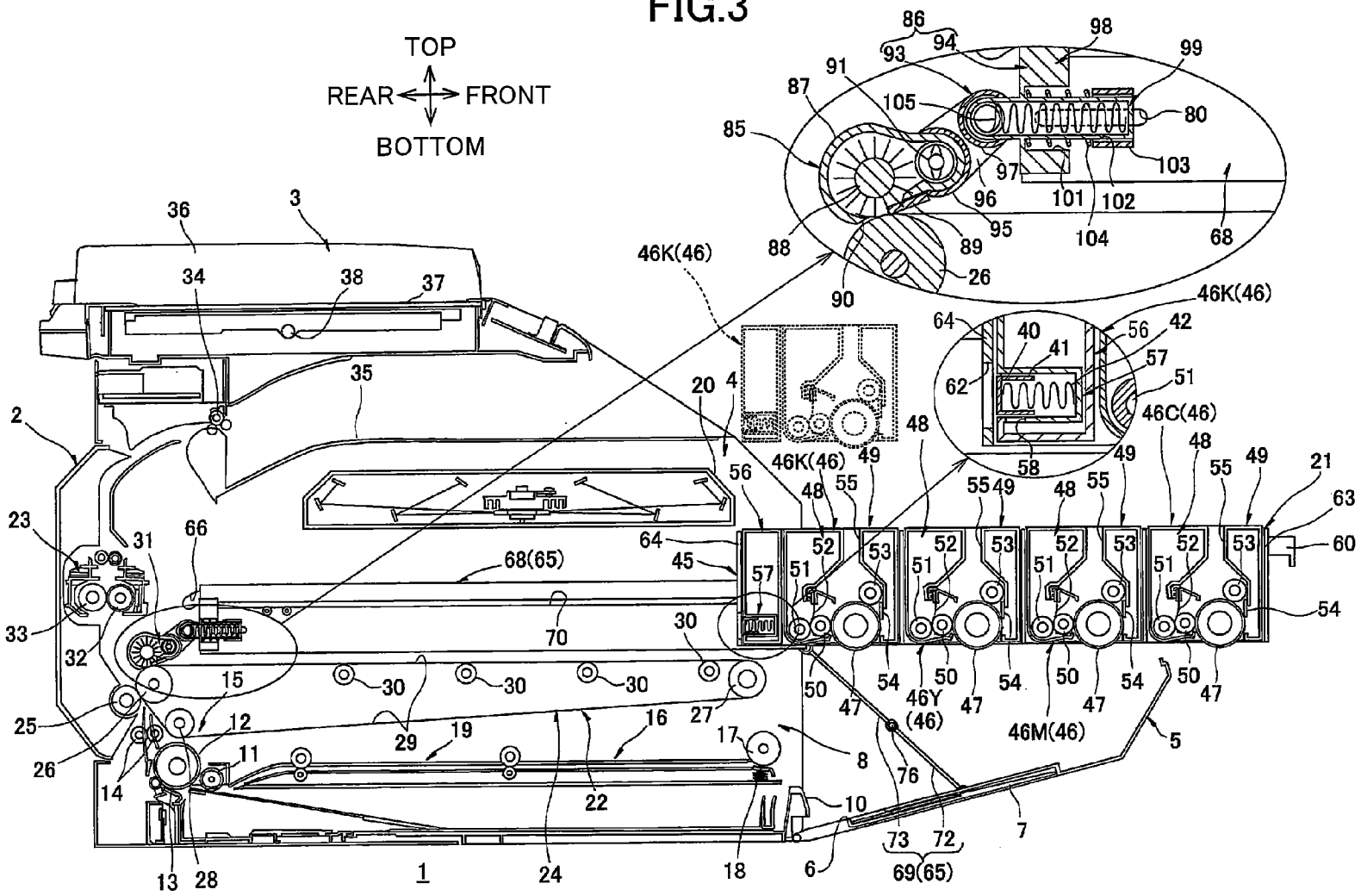
FIG. 3 is a left cross-sectional view of the printer in FIG. 1 when the front cover is in the open position and the process unit is in an external position.
Figure 4:
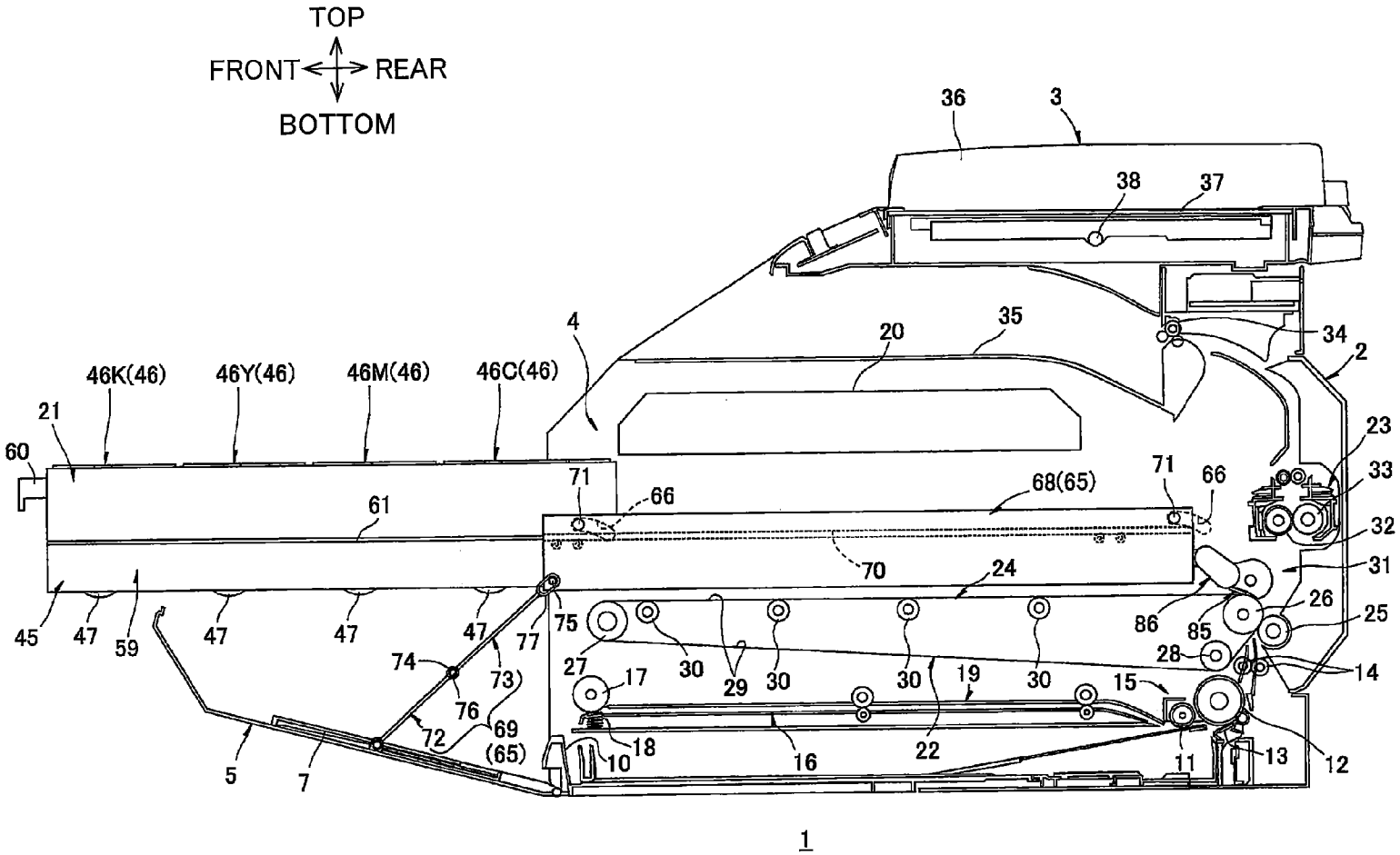
FIG. 4 is a right cross-sectional view of the process unit and an interlocking mechanism in FIG. 3.

As shown in FIGS. 2 and 3, a pair of left and right interlocking mechanisms 65 is provided in the main casing 2 for linking movement of the front cover 5 with movement of the process unit 21. As shown in FIG. 4, a pair of front and rear support-portion guide grooves 66 is formed in the respective left and right side walls of the main casing 2 for guiding drawer support portions 68 described later.

The left and right interlocking mechanisms 65 are spaced apart from each other in the left-right direction. Each interlocking mechanism 65 includes a drawer support portion 68 that slidably supports the process unit 21, and a linking member 69 that links the drawer support portion 68 to the front cover 5.

In this embodiment, the layout and shape of the left interlocking mechanism 65 has left-right symmetry to the layout and shape of the right interlocking mechanism 65. Therefore, the structure of the interlocking mechanisms 65 will be described below using the right interlocking mechanism 65 as an example, while a description of the left interlocking mechanism 65 will be omitted.

The drawer support portion 68 is arranged on the outer left-right side of the process unit 21. The drawer support portion 68 has a generally flat plate shape that is substantially rectangular in a side view and elongated in the front-rear direction. As shown in FIG. 1, the front-rear dimension of the drawer support portion 68 is slightly longer than that of the process unit 21.

Figure 5A:
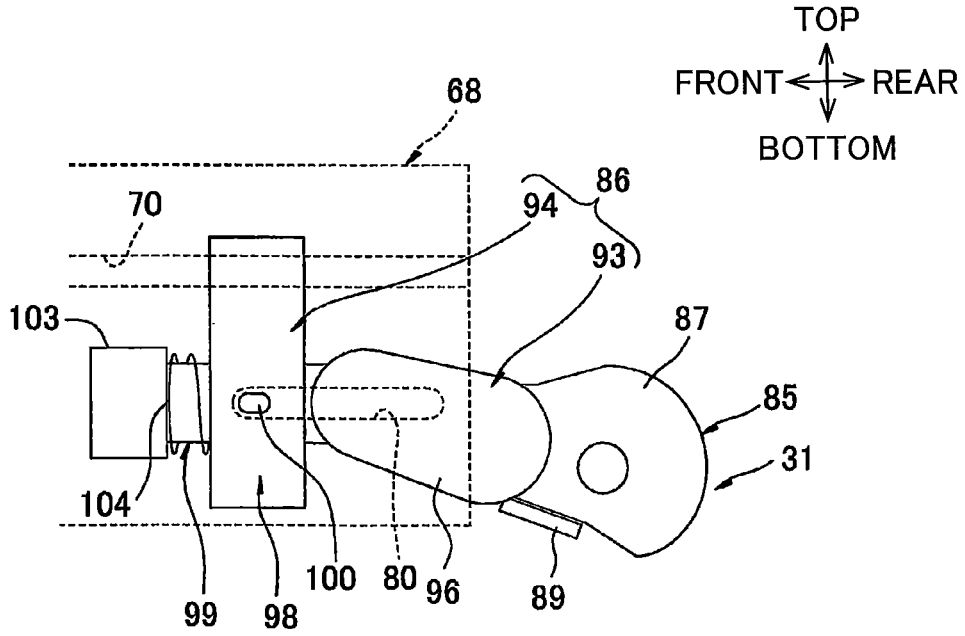
FIG. 5A is a right side view of a belt cleaner in FIG. 4 when a waste-toner conveying unit is in a first position.
Figure 5B:
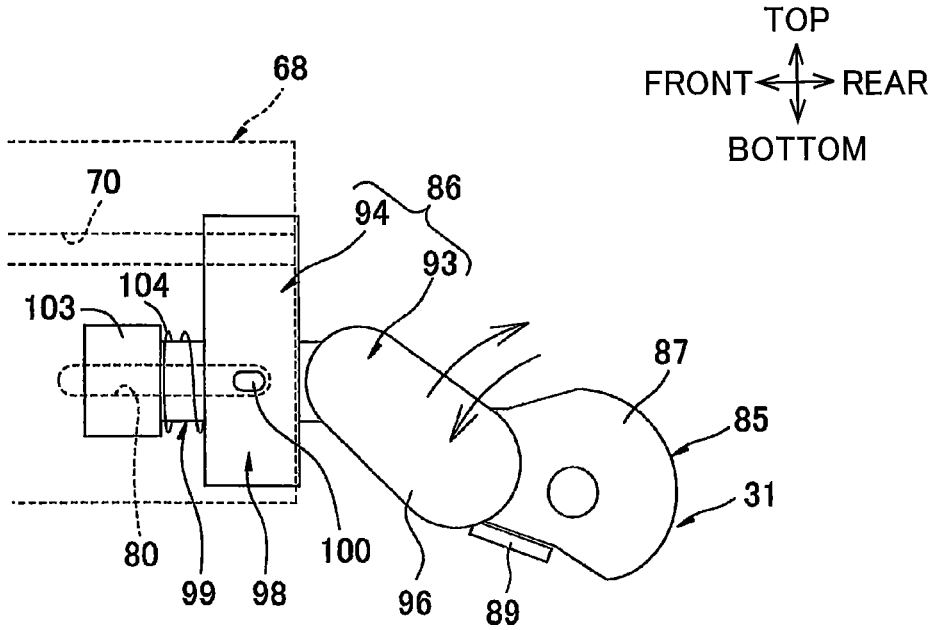
FIG. 5B is a right side view of the belt cleaner in FIG. 4 when the waste-toner conveying unit is in a second position.

As shown in FIG. 3, a drawer guide groove 70 is formed in the drawer support portion 68 for guiding a guided portion 61 (described later) provided on the drawer frame 45. As shown in FIGS. 5A and 5B, a cleaner guide groove 80 is also formed in the drawer support portion 68 for guiding a protruding portion 100 provided on a conveying linkage 94 described later.

As shown in FIG. 3, the drawer guide groove 70 is formed in the inner left-right surface of the drawer support portion 68 at an upper portion thereof and is recessed outward with respect to the left-right direction into the inner left-right surface of the drawer support portions 68. The drawer guide groove 70 extends across the entire drawer support portion 68 in the front-rear direction.

As shown in FIGS. 5A and 5B, the cleaner guide groove 80 is formed in the inner left-right surface of the drawer support portions 68 at a position below a rear end portion of the drawer guide groove 70, with a gap between the drawer guide groove 70 and the cleaner guide groove 80. The cleaner guide groove 80 is recessed outward with respect to the left-right direction into the inner left-right surface of the drawer support portion 68.

As shown in FIG. 4, the drawer support portion 68 is provided with a pair of front and rear guide bosses 71 that is inserted into the corresponding front and rear support-portion guide grooves 66, and a fitting boss 75 that is inserted into a second connection portion 77 (described later).

The guide bosses 71 are provided on the outer left-right surface of the drawer support portion 68 in an upper edge thereof at positions spaced apart in the front-rear direction. Specifically, one guide boss 71 is disposed at an upper front portion of the drawer support portion 68, while the other guide boss 71 is disposed at an upper rear portion of the drawer support portions 68. Each guide bosses 71 has a general columnar shape and protrudes outward with respect to the left-right direction from the outer left-right surface of the drawer support portion 68.

The fitting boss 75 is provided on the outer left-right surface of the drawer support portion 68 at a lower front edge thereof. The fitting boss 75 has a general columnar shape and protrudes outward with respect to the left-right direction from the outer surface of the drawer support portion 68.

As shown in FIGS. 1 and 4, the linking member 69 is disposed on the lower front side of the drawer support portion 68 and includes a first linking portion 72, and a second linking portion 73.

The first linking portion 72 has a general bar shape. One end of the first linking portion 72 is pivotally movably connected to the front cover 5. A first connection portion 74 is integrally provided on the other end of the first linking portion 72. The first connection portion 74 has a generally flat plate shape that is substantially annular in a side view.

The second linking portion 73 also has a general bar shape. A connecting boss 76 is integrally provided on one end of the second linking portion 73, while the second connection portion 77 is integrally provided on the other end of the second linking portion 73.

The connecting boss 76 has a general columnar shape and protrudes outward with respect to the left-right direction from the one end of the second linking portion 73. The connecting boss 76 is rotatably inserted into the first connection portion 74 of the first linking portion 72.

The second connection portion 77 has a generally flat plate shape that is substantially annular elliptical in a side view, with its long dimension oriented from the lower front side to the upper rear side. The fitting boss 75 of the drawer support portion 68 is rotatably inserted into the second connection portion 77. Through this structure, the drawer support portion 68 is linked to the front cover 5 via the linking member 69.

The pair of support-portion guide grooves 66 is each formed in the inner left-right surface of the main casing 2 and is recessed outward with respect to the left-right direction into the inner left-right surface of the main casing 2. Each support-portion guide groove 66 has a curved shape in a side view, extending from the upper front side to the lower rear side.

The drawer support portion 68 is supported on the corresponding side wall of the main casing 2 by movably fitting the front guide boss 71 into the front support-portion guide groove 66 and the rear guide boss 71 into the rear support-portion guide groove 66.

When the front cover 5 is in its closed position shown in FIG. 1, the linking member 69 is folded about the connecting boss 76 to form a general V-shape in a side view with the opening of the V-shape on top. While not shown in FIG. 1, the drawer support portion 68 is disposed in its lowered position, whereby the guide bosses 71 are disposed in the lower rear ends of the corresponding support-portion guide grooves 66.

When the front cover 5 is in its open position shown in FIG. 4, the linking member 69 is extended from the lower front side toward the upper rear side. At this time, the drawer support portion 68 is disposed in its raised position, whereby the guide bosses 71 are disposed in the upper front ends of the corresponding support-portion guide grooves 66.

3. Detailed Description of Process Unit (1) Drawer Frame

As described above, the process unit 21 includes the drawer frame 45.

As shown in FIGS. 1 and 4, the drawer frame 45 includes a pair of side walls 59 arranged in confrontation with each other and spaced apart from each other in the left-right direction, a front wall 63 connecting front edges of the side walls 59, and a rear wall 64 connecting rear edges of the side walls 59.

As shown in FIG. 4, each side wall 59 has a generally flat plate shape that is substantially rectangular in a side view and elongated in the front-rear direction. The guided portion 61 is provided on the outer left-right surface of each side wall 59. The guided portion 61 has a rib-like shape that is elongated in the front-rear direction across the entire side wall 59. The guided portion 61 protrudes outward with respect to the left-right direction from an approximate vertical center region of the outer left-right surface of the side wall 59.

As shown in FIG. 1, the front wall 63 has a generally flat plate shape that is substantially rectangular in a front view and is elongated in the left-right direction.

A grip part 60 is provided on a front surface of the front wall 63. The grip part 60 has a general L-shape in a side view, extending forward from the front surface of the front wall 63 at a top edge thereof, then bending and extending downward.

As shown in FIG. 1, the rear wall 64 has a generally flat plate shape that is substantially rectangular in a rear view and is elongated in the left-right direction.

An insertion hole 62 is formed in a lower edge of the rear wall 64, penetrating the rear wall 64 in the front-rear direction. The insertion hole 62 has a general circular shape in a rear view, with a diameter larger than an outer diameter of a conveying-unit-side shutter 103 (described later).

(2) Black Process Cartridge

A waste toner collection unit (waste toner container) 56 is provided on the rear side of the black process cartridge 46K. In other words, the waste toner collection unit 56 is disposed in proximity to the black process cartridge 46K that is positioned at the most upstream side, among the four process cartridges 46, in a direction that the process unit 21 is moved from the internal position to the external position.

The waste toner collection unit 56 is provided in the process unit 21.

The waste toner collection unit 56 has a box-like shape that is substantially rectangular in a side view and extends vertically. The waste toner collection unit 56 has an insertion hole 40, and a coupling reception portion 57.

The insertion hole 40 is formed in a lower edge of a rear wall of the waste toner collection unit 56, penetrating the rear wall of the waste toner collection unit 56. The insertion hole 40 has a general circular shape in a rear view, with a diameter larger than an outer diameter of an insertion portion 99 (described later) and smaller than the outer diameter of the conveying-unit-side shutter 103 (described later).

The coupling reception portion 57 is provided inside the waste toner collection unit 56. The coupling reception portion 57 has a general hollow cylindrical shape that extends forward from a peripheral edge defining the insertion hole 40 and is closed on its front end.

A reception hole 58 is formed in the coupling reception portion 57. The reception hole 58 penetrates a bottom wall of the coupling reception portion 57 vertically at a rear end portion thereof.

The coupling reception portion 57 includes a collection-unit-side shutter 41. The collection-unit-side shutter 41 has a general hollow cylindrical shape that extends in the front-rear direction and is closed on a rear end thereof. The collection-unit-side shutter 41 is accommodated inside the coupling reception portion 57. The collection-unit-side shutter 41 can be slidingly moved between a closed position shown in FIG. 3 and an open position shown in FIG. 1. In the closed position shown in FIG. 3, the collection-unit-side shutter 41 is disposed in a rear end of the coupling reception portion 57 for closing the reception hole 58. In the open position shown in FIG. 1, the collection-unit-side shutter 41 is disposed in a front end of the coupling reception portion 57 for opening the reception hole 58.

A compression spring 42 is disposed between the coupling reception portion 57 and the collection-unit-side shutter 41. More specifically, the compression spring 42 is interposed between an inner front surface of a rear end of the collection-unit-side shutter 41 and an inner rear surface of a front end of the coupling reception portion 57. The compression spring 42 constantly urges the collection-unit-side shutter 41 rearward.

The black process cartridge 46K is mounted in a rear end portion of the drawer frame 45. When the black process cartridge 46K is mounted in the drawer frame 45, the insertion hole 40 formed in the waste toner collection unit 56 and the insertion hole 62 formed in the rear wall 64 of the drawer frame 45 are aligned with each other in the front-rear direction and are in communication with each other.

(3) Associated Operations of Process Unit and Drawer Support Portions

As shown in FIG. 4, the process unit 21 is supported by the drawer support portions 68 so as to be slidingly movable in the front-rear direction by fitting the guided portions 61 into the corresponding drawer guide grooves 70.

When the front cover 5 is disposed in the closed position and the drawer support portions 68 are disposed in the lowered position, as shown in FIG. 1, the process unit 21 is disposed in a contact position in which the plurality of photosensitive drums 47 contacts the upper portion of the intermediate transfer belt 29 on the upper side thereof.

When the front cover 5 is disposed in the open position and the drawer support portions 68 are disposed in the raised position shown in FIG. 2, the process unit 21 is disposed in a separated position in which the plurality of photosensitive drums 47 is vertically spaced apart from the intermediate transfer belt 29.

Hence, the process unit 21 can move between the contact position and the separated position while remaining in the internal position inside the main casing 2.

4. Detailed Description of Belt Cleaner (1) Waste Toner Recovery Unit and Waste Toner Conveying Unit As shown in FIG. 1, the belt cleaner 31 includes a waste toner recovery unit (belt cleaning unit) 85, a waste toner conveying unit 86, and a screw 91.

The waste toner recovery unit 85 constitutes a rear portion of the belt cleaner 31 and is disposed above the drive roller 26, with the intermediate transfer belt 29 interposed between the waste toner recovery unit 85 and the drive roller 26. Further, the waste toner recovery unit 85 is disposed rearward of the waste toner collection unit 56.

In other words, the waste toner recovery unit 85 is disposed upstream of the waste toner collection unit 56 in a direction that the process unit 21 is moved from the internal position to the external position.

The waste toner recovery unit 85 includes a recovery-unit frame 87, a brush roller 88, and a cleaning blade 89.

The recovery-unit frame 87 has a general elliptical shape in a side view, with its long dimension aligned in the front-rear direction. The recovery-unit frame 87 is elongated in the left-right direction and has a hollow configuration. As shown in FIGS. 5A and 5B, left and right ends of the recovery-unit frame 87 are closed.

The recovery-unit frame 87 is provided with a first fitting tube (not shown), and an opening 90 shown in FIG. 1. The first fitting tube (not shown) has a general hollow cylindrical shape and extends rightward from a right wall of the recovery-unit frame 87 at a front portion thereof. The first fitting tube (not shown) communicates with the interior of the recovery-unit frame 87. The opening 90 is formed in a bottom wall of the recovery-unit frame 87 at a rear end portion thereof and penetrates the bottom wall of the recovery-unit frame 87 vertically. The opening 90 is elongated in the left-right direction.

The brush roller 88 is accommodated in a rear portion of the recovery-unit frame 87, with its axis extending in the left-right direction. The brush roller 88 is supported in the recovery-unit frame 87 with left and right ends of the brush roller 88 rotatably supported in the corresponding left and right side walls of the recovery-unit frame 87.

The cleaning blade 89 has a generally flat plate shape and is elongated in the front-rear and left-right directions. A front end of the cleaning blade 89 is fixed to a peripheral edge defining the front side of the opening 90 formed in the recovery-unit frame 87 such that a rear end of the cleaning blade 89 contacts the intermediate transfer belt 29. With this arrangement, the intermediate transfer belt 29 looped around the drive roller 26 is interposed between the rear end of the cleaning blade 89 and the drive roller 26.

The screw 91 is disposed in a front portion of the recovery-unit frame 87 at a position forward of the brush roller 88. The screw 91 is an auger screw oriented with its axis in the left-right direction.

The waste toner recovery unit 85 is fixed to the main casing 2.

The waste toner conveying unit 86 constitutes a front portion of the belt cleaner 31 and is disposed between the left and right drawer support portions 68. The waste toner conveying unit 86 includes a conveying pipe 93, the conveying linkage 94, and a screw 105.

As shown in FIGS. 5A and 5B, the conveying pipe 93 is disposed rightward of the recovery-unit frame 87 and the insertion portion 99 (described later). The conveying pipe 93 has a pipe-like shape. In a plan view, the conveying pipe 93 has a generally rectangular U-shape, with both front and rear ends bent leftward. More specifically, the conveying pipe 93 integrally includes a first fitting portion 95, a joining portion 96, and a second fitting portion 97, as shown in FIG. 1.

The first fitting portion 95 constitutes a rear portion of the conveying pipe 93 and is elongated in the left-right direction. The first fitting portion 95 is rotatably fitted with the first fitting tube (not shown) on the radially outer side thereof such that the first fitting portion 95 communicates with the interior of the recovery-unit frame 87. The first fitting portion 95 has an inner diameter substantially the same as an outer diameter of the first fitting tube.

The joining portion 96 bends and extends forward from a right end of the first fitting portion 95.

The second fitting portion 97 constitutes a front portion of the conveying pipe 93, and bends and extends leftward from a front end of the joining portion 96.

The conveying linkage 94 is integrally provided with a body portion 98, and the insertion portion 99.

The body portion 98 has a general rectangular shape in a side view that is elongated in the vertical direction. The body portion 98 also has a rectangular columnar configuration that is elongated in the left-right direction. As shown in FIGS. 5A and 5B, the protruding portion 100 is integrally provided on each of left and right endfaces of the body portion 98. The protruding portions 100 are guided in the corresponding cleaner guide grooves 80.

The protruding portion 100 protrudes outward with respect to the left-right direction from an approximate center region of the respective left-right endface of the body portion 98. The protruding portion 100 is generally elliptical in a side view, with its long dimension aligned in the front-rear direction.

As shown in FIG. 1, the insertion portion 99 has a general hollow cylindrical shape that is elongated in the front-rear direction and closed on both front and rear ends. When projected in the front-rear direction, the insertion portion 99 is aligned with the insertion hole 62 formed in the drawer frame 45. The insertion portion 99 penetrates the body portion 98 in the front-rear direction.

The insertion portion 99 is provided with a second fitting tube (not shown), and a discharge hole 102. The second fitting tube (not shown) has a general hollow cylindrical shape and extends continuously rightward from a rear end of the insertion portion 99. The second fitting portion 97 of the conveying pipe 93 is rotatably fitted with the second fitting tube (not shown) on the radially outer side thereof to provide communication between the interiors of the conveying pipe 93 and the insertion portion 99. The second fitting tube (not shown) has an outer diameter substantially the same as an inner diameter of the second fitting portion 97.

The discharge hole 102 is formed in a bottom wall of the insertion portion 99 at a front end portion thereof and penetrates the bottom wall of the insertion portion 99 vertically.

A spring accommodating groove 101 is formed in the body portion 98 along an outer circumference of the insertion portion 99. The spring accommodating groove 101 is recessed rearward into a front surface of the body portion 98.

The insertion portion 99 also includes the conveying-unit-side shutter 103. The conveying-unit-side shutter 103 has a general hollow cylindrical shape that extends in the front-rear direction. The conveying-unit-side shutter 103 is fitted around the outer circumference of the insertion portion 99. The conveying-unit-side shutter 103 can be slidingly moved between a closed position shown in FIG. 3, and an open position shown in FIG. 1. In the closed position shown in FIG. 3, the conveying-unit-side shutter 103 is disposed at a front end of the insertion portion 99 for closing the discharge hole 102. In the open position shown in FIG. 1, the conveying-unit-side shutter 103 is disposed at an approximate front-rear center region of the insertion portion 99 for exposing the discharge hole 102.

A compression spring 104 is interposed between a rear end of the conveying-unit-side shutter 103 and an inner front surface of the spring accommodating groove 101. The compression spring 104 constantly urges the conveying-unit-side shutter 103 forward.

The screw 105 is accommodated inside the conveying pipe 93 and the insertion portion 99. The screw 105 is formed in a general coil spring shape.

As shown in FIGS. 5A and 5B, the conveying linkage 94 is supported in the left and right drawer support portions 68 by fitting the protruding portions 100 of the body portion 98 into the corresponding cleaner guide grooves 80 so as to be capable of sliding in the front-rear direction.

(2) Associated Operations of Waste Toner Collection Unit and Waste Toner Conveying Unit When the process unit 21 is disposed in the contact position, the waste toner conveying unit 86 is disposed in a first position shown in FIG. 5A. In the first position, the protruding portions 100 of the conveying linkage 94 are disposed in front ends of the corresponding cleaner guide grooves 80.

When the waste toner conveying unit 86 is in the first position, the insertion portion 99 of the conveying linkage 94 is inserted into the coupling reception portion 57 of the waste toner collection unit 56 such that the discharge hole 102 and the reception hole 58 are vertically aligned with each other, as shown in FIG. 1. In other words, when the waste toner conveying unit 86 is in the first position, the discharge hole 102 vertically confronts the reception hole 58.

Further, the collection-unit-side shutter 41 is contacted by the front end of the insertion portion 99 and thereby disposed in its open position against the urging force of the compression spring 42. Similarly, the conveying-unit-side shutter 103 is contacted by the peripheral edge defining the insertion hole 40 and thereby disposed in its open position against the urging force of the compression spring 104.

When the process unit 21 is disposed in the separated position, the waste toner conveying unit 86 is in a second position shown in FIG. 5B. In the second position, the protruding portions 100 of the conveying linkage 94 are disposed in rear ends of the corresponding cleaner guide grooves 80.

When the waste toner conveying unit 86 is in the second position, the insertion portion 99 of the conveying linkage 94 is inserted into the coupling reception portion 57 of the waste toner collection unit 56 such that a front portion of the discharge hole 102 is vertically aligned with a rear portion of the reception hole 58, as shown in FIG. 2. In other words, when the waste toner conveying unit 86 is in the second position, the front portion of the discharge hole 102 vertically confronts the rear portion of the reception hole 58.

Hence, the coupling reception portion 57 and the insertion portion 99 remain coupled, regardless of whether the waste toner conveying unit 86 is in the first position or in the second position.

5. Operations for Withdrawing and Mounting Process Unit relative to Main Casing

Next, operations for withdrawing the process unit 21 from the main casing 2 and mounting the process unit 21 into the main casing 2 will be described.

When the printer 1 is performing an image-forming operation, the front cover 5 is in the closed position and the process unit 21 is in the contact position, as shown in FIG. 1.

(1) Operation for Withdrawing Process Unit from Main Casing

In order to withdraw the process unit 21 from the main casing 2, an user first pivotally moves the front cover 5 clockwise in a left side view from the closed position to the open position, as shown in FIGS. 1 and 2.

As the front cover 5 is pivotally moved to be open, the second connection portions 77 of the linking members 69 pull the corresponding fitting bosses 75 diagonally downward and forward. Accordingly, the linking members 69 pull the corresponding drawer support portions 68 diagonally downward and forward through the fitting bosses 75. As a result, the drawer support portions 68 slide diagonally upward and forward from the lowered position as the guide bosses 71 are guided in the corresponding support-portion guide grooves 66. The process unit 21 also moves diagonally upward and forward from the contact position along with the movement of the drawer support portions 68.

When the front cover 5 reaches the open position shown in FIG. 4, the guide bosses 71 contact the front ends of the corresponding support-portion guide grooves 66 from the rear side thereof. This contact restricts the drawer support portions 68 from moving further forward.

Through this operation, the drawer support portions 68 are moved from the lowered position to the raised position while the process unit 21 is moved from the contact position to the separated position. Hence, the interlocking mechanisms 65 serve to move the process unit 21 from the contact position to the separated position as the front cover 5 moves from the closed position to the open position.

As shown in FIGS. 2 and 5B, when the drawer support portions 68 is moved from the lowered position to the raised position, the conveying linkage 94 is also moved upward along with the movement of the drawer support portions 68 from the lowered position to the raised position, and the second fitting portion 97 of the conveying pipe 93 moves upward along with the movement of the conveying linkage 94.

Consequently, the conveying pipe 93 pivotally moves clockwise in a right side view about the first fitting portion 95, pivotally moving the waste toner conveying unit 86 from the first position to the second position.

At this time, the front end of the insertion portion 99 is maintained in its inserted state in the coupling reception portion 57, as shown in FIG. 2. Further, the front half portion of the discharge hole 102 vertically opposes the rear half portion of the reception hole 58. That is, the discharge hole 102 is in communication with the reception hole 58.

Hence, the waste toner conveying unit 86 pivotally moves from the first position to the second position along with the movement of the process unit 21 from the contact position to the separated position, while the insertion portion 99 remains coupled to the coupling reception portion 57.

Next, the user grips the grip part 60 of the drawer frame 45 and pulls the process unit 21 forward from the internal position.

While the user pulls the process unit 21 forward from the internal position, the guided portions 61 of the drawer frame 45 are guided along the corresponding drawer guide grooves 70, as shown in FIG. 4.

As the process unit 21 is pulled forward, the insertion portion 99 is separated from the coupling reception portion 57, as shown in FIG. 3. In other words, the insertion portion 99 and the coupling reception portion 57 are uncoupled as the process unit 21 moves from the internal position toward the external position.

During this process, the front end of the insertion portion 99 separates from the rear end of the collection-unit-side shutter 41, and the front end of the conveying-unit-side shutter 103 separates from the peripheral edge defining the insertion hole 40. Consequently, the urging force of the compression spring 42 moves the collection-unit-side shutter 41 from the open position to the closed position, and the urging force of the compression spring 104 moves the conveying-unit-side shutter 103 from the open position to the closed position.

As the user continues to pull the process unit 21 forward, the process unit 21 is withdrawn from the main casing 2 through the opening 4.

At this time, the process unit 21 is in the external position, whereby all process cartridges 46 are exposed from above.

This completes the operation for withdrawing the process unit 21 from the internal position to the external position.

This operation is performed when replacing the process cartridge 46 in the printer 1, for example. The process cartridges 46 are removed from and mounted in the drawer frame 45 while the process unit 21 is disposed in the external position.

More specifically, in order to remove the process cartridge 46 from the drawer frame 45, the user lifts the process cartridge 46 upward until the process cartridge 46 separates from the drawer frame 45, as indicated by broken lines in FIG. 3. In order to mount the process cartridge 46 into the drawer frame 45, the user inserts the process cartridge 46 into the drawer frame 45 from above.

(2) Operation for Mounting Process Unit in Main Casing

In order to mount the process unit 21 from the external position to the internal position inside the main casing 2, the operation described above for withdrawing the process unit 21 from the main casing 2 is performed in reverse.

That is, the user grips the grip part 60 on the drawer frame 45 and pushes the process unit 21 rearward. At this time, the process unit 21 moves rearward from the external position toward the internal position as the guided portions 61 of the drawer frame 45 are guided in the corresponding drawer guide grooves 70.

Since the drawer support portions 68 are in the raised position at this time, as shown in FIG. 2, the process unit 21 moves rearward with the photosensitive drums 47 vertically spaced apart from the intermediate transfer belt 29.

As the process unit 21 arrives at the internal position, the front end of the insertion portion 99 and the front end of the conveying-unit-side shutter 103 are inserted into the insertion hole 62 of the drawer frame 45, and the front end of the insertion portion 99 is further inserted into the coupling reception portion 57 of the waste toner collection unit 56. Thus, the insertion portion 99 and the coupling reception portion 57 become coupled.

At the same time, the peripheral edge defining the insertion hole 40 of the waste toner collection unit 56 contacts the front end of the conveying-unit-side shutter 103 from front, and the rear end of the collection-unit-side shutter 41 contacts the front end of the insertion portion 99 from front.

Consequently, the peripheral edge defining the insertion hole 40 pushes the conveying-unit-side shutter 103 rearward, causing the conveying-unit-side shutter 103 to move rearward from the closed position against the urging force of the compression spring 104. Further, the front end of the insertion portion 99 pushes the collection-unit-side shutter 41 forward, causing the collection-unit-side shutter 41 to move forward from the closed position against the urging force of the compression spring 42.

Next, the user pivotally moves the front cover 5 from the open position to the closed position.

As the front cover 5 is pivotally moved toward the closed position, the linking members 69 are folded about the connecting bosses 76 to form a general V-shape in a side view, as shown in FIG. 1.

Accordingly, the linking members 69 release their tension on the drawer support portions 68, allowing the drawer support portions 68 to slide diagonally downward and rearward from the raised position by the weight of the process unit 21, as the guide bosses 71 are guided in the corresponding support-portion guide grooves 66.

When the guide bosses 71 contact the rear ends of the corresponding support-portion guide grooves 66 from the front side thereof, further downward movement of the drawer support portions 68 is restricted. At this time, the drawer support portions 68 are in the lowered position. Thus, the drawer support portions 68 are moved from the raised position to the lowered position as the front cover 5 moves from the open position to the closed position.

At the same time, the process unit 21 supported by the drawer support portions 68 moves from the separated position to the contact position as the drawer support portions 68 move from the raised position to the lowered position. Hence, the interlocking mechanisms 65 serve to move the process unit 21 from the separated position to the contact position as the front cover 5 moves from the open position to the closed position.

As shown in FIGS. 1 and 5B, when the drawer support portions 68 is moved from the raised position to the lowered position, the conveying linkage 94 and the second fitting portion 97 are also moved downward along with the movement of the drawer support portions 68 from the raised position to the lowered position.

Consequently, the conveying pipe 93 pivotally moves counterclockwise in a right side view about the first fitting portion 95, pivotally moving the waste toner conveying unit 86 from the second position to the first position.

Hence, the waste toner conveying unit 86 pivotally moves from the second position to the first position along with the movement of the process unit 21 from the separated position to the contact position, while the insertion portion 99 remains coupled to the coupling reception portion 57.

Through this operation, the insertion portion 99 advances further forward into the coupling reception portion 57. The discharge hole 102 and the reception hole 58 are vertically aligned with each other and in communication with each other, as shown in FIG. 1.

At the same time, the peripheral edge defining the insertion hole 40 pushes the front end of the conveying-unit-side shutter 103 further rearward, moving the conveying-unit-side shutter 103 into the open position against the urging force of the compression spring 104. Further, the front end of the insertion portion 99 pushes the rear end of the collection-unit-side shutter 41 further forward, moving the collection-unit-side shutter 41 into the open position against the urging force of the compression spring 42.

This completes the operation for mounting the process unit 21 in the main casing 2 from the external position to the internal position.

6. Operation for Collecting Waste Toner (Cleaning Operation)

At the beginning of an image-forming operation in the printer 1, a drive source (not shown) provided inside the main casing 2 generates a drive force for rotating the brush roller 88 of the waste toner recovery unit 85, the screw 91, and the screw 105 of the waste toner conveying unit 86, as shown in FIG. 1.

As described above, during the image-forming operation performed by the printer 1, toner images carried on the surfaces of the photosensitive drums 47 are sequentially transferred in a primary transfer onto the upper portion of the intermediate transfer belt 29 as the upper portion moves forward. Any toner remaining on the surfaces of the photosensitive drums 47 after the primary transfer has been completed, i.e., residual toner on the photosensitive drums 47 that was not transferred onto the intermediate transfer belt 29, is considered waste toner.

As the photosensitive drums 47 continue to rotate, the waste toner is scraped off from the photosensitive drums 47 by the corresponding drum-cleaning blades 54. The toner scraped off by the drum-cleaning blades 54 falls through the corresponding openings 79 and is collected in the corresponding toner recovery units 49.

Next, the color image formed on the intermediate transfer belt 29 is transferred in a secondary transfer onto a sheet S supplied from the sheet-feeding unit 8 as the intermediate transfer belt 29 passes through the position opposing the secondary transfer roller 25, as described above.

Any toner remaining on the intermediate transfer belt 29 after the secondary transfer has been completed is considered waste toner. Waste toner on the intermediate transfer belt 29 includes residual toner that was not transferred onto the sheet S, and paper dust deposited on the intermediate transfer belt 29 when the sheet S passes through the position between the intermediate transfer belt 29 and the secondary transfer roller 25.

As the intermediate transfer belt 29 continues to circularly move, this waste toner is brought opposite the cleaning blade 89, and the cleaning blade 89 scrapes off the waste toner from the intermediate transfer belt 29. The waste toner scraped off by the cleaning blade 89 collects in the recovery-unit frame 87 through the opening 90. In this way, waste toner is removed from the intermediate transfer belt 29.

Subsequently, the brush roller 88 rotating inside the recovery-unit frame 87 conveys the collected waste toner in a forward direction toward the screw 91. The rotating screw 91 in turn conveys this toner rightward within the recovery-unit frame 87 into the first fitting portion 95 of the conveying pipe 93.

The screw 105 rotates to convey the waste toner received in the first fitting portion 95 from the first fitting portion 95 to the second fitting portion 97 through the joining portion 96. Once the waste toner is conveyed into the second fitting portion 97, the screw 105 conveys the waste toner from the second fitting portion 97 into the insertion portion 99 and continues to convey the waste toner forward within the insertion portion 99.

When the waste toner arrives at the front end portion of the insertion portion 99, the waste toner drops by its own weight through the discharge hole 102 and the reception hole 58 and is stored in the waste toner collection unit 56. Hence, when the waste toner is collected by the waste toner recovery unit 85, the waste toner conveying unit 86 conveys this waste toner from the waste toner recovery unit 85 to the waste toner collection unit 56.

This completes the cleaning operation of the printer 1.

7. Operational Advantages (1) As shown in FIGS. 1 and 2, the process unit 21 of the printer 1 can move between the contact position and the separated position while remaining in the internal position. Accordingly, the process unit 21 can be moved between the internal position and the external position while the plurality of photosensitive drums 47 remains separated from the intermediate transfer belt 29, as shown in FIGS. 2 through 4.

More specifically, when withdrawing the process unit 21 from the main casing 2 (i.e. moving the process unit 21 from the internal position to the external position), the process unit 21 can be moved from the internal position to the external position shown in FIG. 3 after the process unit 21 has been placed in the separated position shown in FIG. 2. Similarly, when mounting the process unit 21 into the main casing 2 (i.e. moving the process unit 21 from the external position to the internal position), the process unit 21 is first moved from the external position to the internal position while the plurality of photosensitive drums 47 remain separated from the intermediate transfer belt 29, and is subsequently moved from the separated position to the contact position shown in FIG. 1.

This configuration ensures that the process unit 21 can be moved smoothly between the internal position and the external position without the plurality of photosensitive drums 47 sliding over the intermediate transfer belt 29, as shown in FIGS. 1 through 3. Further, since the waste toner collection unit 56 and the waste toner conveying unit 86 can be smoothly coupled while the process unit 21 moves linearly from the external position to the internal position, this configuration reduces the likelihood of damage to the coupling parts between the waste toner collection unit 56 and the waste toner conveying unit 86, and specifically to the insertion portion 99 of the waste toner conveying unit 86 and the coupling reception portion 57 of the waste toner collection unit 56.

Further, when the process unit 21 is moved from the separated position shown in FIG. 2 to the contact position shown in FIG. 1 after being moved from the external position to the internal position, the waste toner conveying unit 86 moves along with the movement of the process unit 21 from the separated position to the contact position.

This configuration can improve the precision in positioning the waste toner collection unit 56 and the waste toner conveying unit 86 relative to each other. Thus, the waste toner conveying unit 86 can reliably convey waste toner collected by the waste toner recovery unit 85 to the waste toner collection unit 56.

Accordingly, the printer 1 according to the above-described embodiment prevents the plurality of photosensitive drums 47 from sliding over the intermediate transfer belt 29 when the process unit 21 is moved between the internal position and the external position, while ensuring that waste toner collected by the waste toner recovery unit 85 can be reliably conveyed to the waste toner collection unit 56.

(2) While the process unit 21 is in the internal position, the insertion portion 99 of the waste toner conveying unit 86 is always coupled to the coupling reception portion 57 of the waste toner collection unit 56, as shown in FIGS. 1 and 2. When the process unit 21 is moved from the contact position to the separated position, the waste toner conveying unit 86 moves from the first position to the second position while the insertion portion 99 and the coupling reception portion 57 remain coupled to each other. Further, when the process unit 21 is moved from the separated position to the contact position, the waste toner conveying unit 86 moves from the second position to the first position while the insertion portion 99 and the coupling reception portion 57 remain coupled to each other.

This arrangement can move the process unit 21 in the front-rear direction from the external position to the internal position while the photosensitive drums 47 are separated from the intermediate transfer belt 29, as shown in FIGS. 1 through 3. The process unit 21 can also be moved from the separated position to the contact position after the insertion portion 99 has been coupled to the coupling reception portion 57.

In this way, the configuration of the printer 1 according to the above-described embodiment prevents the plurality of photosensitive drums 47 from sliding over the intermediate transfer belt 29 when the process unit 21 is moved from the external position to the internal position, while ensuring that the insertion portion 99 of the waste toner conveying unit 86 can be reliably coupled to the coupling reception portion 57 of the waste toner collection unit 56. As a result, the waste toner conveying unit 86 can more reliably convey waste toner collected by the waste toner recovery unit 85 to the waste toner collection unit 56.

Further, since the process unit 21 can be moved from the separated position to the contact position while the waste toner conveying unit 86 and the waste toner collection unit 56 remain coupled, as shown in FIGS. 1 and 2, the printer 1 according to the above-described embodiment reduces the likelihood of damage to the insertion portion 99 of the waste toner conveying unit 86 and the coupling reception portion 57 of the waste toner collection unit 56 resulting from the movement of the process unit 21.

That is, it is necessary to fix the position of the photosensitive drums 47 relative to the main casing 2 when moving the process unit 21 to the contact position. Hence, by moving the process unit 21 vertically (downward from above) after the process unit 21 has been moved from the external position to the internal position, the photosensitive drums 47 can be placed in contact with the intermediate transfer belt 29 and positioned relative to the main casing 2.

However, if the waste toner conveying unit 86 and the waste toner collection unit 56 are coupled to each other when moving the process unit 21 to the contact position, then the photosensitive drums 47 must be positioned relative to the main casing 2 at the same time the waste toner conveying unit 86 is coupled to the waste toner collection unit 56.

Accordingly, when it is not possible to ensure both the precision of positioning the photosensitive drums 47 relative to the main casing 2 and the precision of positioning the waste toner collection unit 56 relative to the waste toner conveying unit 86, the waste toner conveying unit 86 may not be smoothly coupled to the waste toner collection unit 56, resulting in damage to the insertion portion 99 of the waste toner conveying unit 86 or the coupling reception portion 57 of the waste toner collection unit 56 while moving the process unit 21 to the contact position.

In contrast, the printer 1 according to the above-described embodiment moves the process unit 21 from the separated position to the contact position while the waste toner conveying unit 86 remains coupled to the waste toner collection unit 56.

This configuration reduces the likelihood of damage to the insertion portion 99 of the waste toner conveying unit 86 and the coupling reception portion 57 of the waste toner collection unit 56 resulting from the movement of the process unit 21 to the contact position.

(3) As shown in FIGS. 5A and 5B, the waste toner conveying unit 86 can be pivotally moved between the first position and the second position about the first fitting portion 95. By ensuring that the waste toner conveying unit 86 moves smoothly between the first and second positions in this way, it is possible to ensure the smooth movement of the process unit 21 between the contact position shown in FIG. 1 and the separated position shown in FIG. 2.

(4) As shown in FIGS. 1 and 2, the interlocking mechanisms 65 in the printer 1 according to the above-described embodiment move the process unit 21 from the contact position to the separated position while the front cover 5 is moved from the closed position to the open position.

This configuration makes the operation for moving the process unit 21 from the contact position to the separated position more efficient than an arrangement in which the front cover 5 and the process unit 21 move independently.

Further, since the interlocking mechanisms 65 maintain the process unit 21 in the separated position while the front cover 5 is in the open position, as shown in FIG. 2, the plurality of photosensitive drums 47 reliably remains separated from the intermediate transfer belt 29 while the process unit 21 is withdrawn from the main casing 2, as shown in FIG. 3.

Thus, the configuration of the printer 1 according to the above-described embodiment improves the efficiency of the operation for moving the process unit 21 from the internal position to the external position, while reliably preventing the plurality of photosensitive drums 47 from sliding over the intermediate transfer belt 29.

Since the process unit 21 moves from the separated position to the contact position in association with the closing operation of the front cover 5, there may be some concern that the process unit 21 could oscillate while moving from the separated position to the contact position. Here, if the waste toner conveying unit 86 is to be coupled to the waste toner collection unit 56 when the process unit 21 moves into the contact position, it can be difficult to ensure both the precision of positioning the photosensitive drums 47 relative to the main casing 2 and the precision of positioning the waste toner collection unit 56 relative to the waste toner conveying unit 86. Thus, it may be difficult to ensure that the waste toner conveying unit 86 and the waste toner collection unit 56 are coupled smoothly.

However, the configuration of the printer 1 according to the above-described embodiment moves the process unit 21 from the separated position to the contact position while the waste toner conveying unit 86 and the waste toner collection unit 56 are in the coupled state, thereby ensuring that the waste toner conveying unit 86 and the waste toner collection unit 56 are coupled smoothly.

(5) As shown in FIG. 1, the waste toner collection unit 56 is provided in proximity to the rearmost black process cartridge 46K in the printer 1 according to the above-described embodiment.

Hence, through a simple construction, the waste toner conveying unit 86 can be uncoupled from the waste toner collection unit 56 by moving the process unit 21 from the internal position to the external position and can be coupled to the waste toner collection unit 56 by moving the process unit 21 from the external position to the internal position.

(6) Further, the waste toner recovery unit 85 is disposed on the rear side of the waste toner collection unit 56, as shown in FIG. 1.

This arrangement prevents the waste toner recovery unit 85 from interfering with movement of the process unit 21.

8. Modifications

Various modifications are conceivable.

In addition to the intermediate transfer tandem-type color printer described in the embodiment, the image forming apparatus of the present invention may be configured as a direct tandem-type color printer.

In case the printer 1 is configured as a direct tandem-type color printer, the printer 1 is provided with a paper-conveying belt in place of the intermediate transfer belt 29. In this case, the sheet-feeding unit 8 and the paper-conveying belt conveys a sheet S to positions between the photosensitive drums 47 and the corresponding transfer rollers 30, and toner images are sequentially transferred from the photosensitive drums 47 onto the sheet S to form a color image as the sheet S passes through the positions between the photosensitive drums 47 and the corresponding transfer rollers 30.

In the printer 1 according to the above-described embodiment, the recovery-unit frame 87 and the insertion portion 99 are connected by the conveying pipe 93 having a rectangular U-shape in a plan view. However, the recovery-unit frame 87 and the insertion portion 99 may be connected by a conveying pipe configured of a flexible and deformable tube.

These modifications of the above-described embodiment can obtain the same operational advantages described in the embodiment. Further, the above-described embodiment and modifications can be arbitrarily combined with each other.

While the present invention has been described in detail with reference to the embodiments thereof, it would be apparent to those skilled in the art that various changes and modifications may be made therein without departing from the spirit of the present invention.

What is claimed is:

1. An image forming apparatus configured to form an image on a photosensitive body by using toner accommodated in a cartridge, the image forming apparatus comprising:

a main casing;

a belt unit including a belt and a belt cleaning unit configured to collect waste toner adhered to the belt;

a waste toner container configured to store the waste toner collected by the belt cleaning unit;

a conveying unit configured to be coupled to the waste toner container and to convey the waste toner collected by the belt cleaning unit from the belt cleaning unit to the waste toner container; and a drawer frame configured to support the cartridge and the waste toner container, the drawer frame being configured to move between an internal position where the drawer frame is inside the main casing and an external position where the drawer frame is at least partly outside the main casing, the drawer frame in the internal position being configured to move between a contact position where the photosensitive body is in contact with the belt and a separated position where the photosensitive body is spaced apart from the belt, wherein the conveying unit has a conveying linkage and a conveying pipe, the conveying linkage having a discharge hole configured to communicate with the waste toner container, and the conveying pipe being rotatably fitted with both the belt cleaning unit and the conveying linkage, and wherein the conveying pipe is configured to move pivotally about the belt cleaning unit along with movement of the drawer frame between the contact position and the separated position, the conveying linkage being configured to be uncoupled from the waste toner container while the drawer frame moves from the internal position to the external position.

2. The image forming apparatus as claimed in claim 1, wherein the conveying linkage is coupled to the waste toner container while the drawer frame is in the internal position, the conveying linkage being further configured to move between a first position and a second position while remaining coupled to the waste toner container, the conveying linkage being placed in the first position when the drawer frame is in the contact position and being placed in the second position when the drawer frame is in the separated position.

3. The image forming apparatus as claimed in claim 1, wherein the main casing is formed with an opening through which the drawer frame moves between the internal position and the external position, and wherein the main casing includes:

a movable member configured to move between an open position for exposing the opening and a closed position for covering the opening; and an interlocking mechanism configured to move the drawer frame from the contact position to the separated position in response to movement of the movable member from the closed position to the open position and configured to move the drawer frame from the separated position to the contact position in response to movement of the movable member from the open position to the closed position.

4. The image forming apparatus as claimed in claim 1, wherein the drawer frame moves from the internal position to the external position in a moving direction, wherein the photosensitive body includes a plurality of photosensitive members, the plurality of photosensitive members being arranged juxtaposed with each other in the moving direction and including a first photosensitive member disposed most upstream of the photosensitive members in the moving direction, and wherein the waste toner container is disposed adjacent to the first photosensitive member.

5. The image forming apparatus as claimed in claim 4, wherein the belt cleaning unit is disposed upstream of the waste toner container in the moving direction.

6. The image forming apparatus as claimed in claim 1, further comprising a drawer support portion supporting the drawer frame when the drawer frame is in the internal position.

7. The image forming apparatus as claimed in claim 6, wherein the drawer support portion is configured to move between a raised position and a lowered position, the drawer frame being placed in the separated position when the drawer support portion is in the raised position, and the drawer frame being placed in the contact position when the drawer support portion is in the lowered position.

8. The image forming apparatus as claimed in claim 7, wherein the drawer support portion supports the conveying linkage, the conveying linkage moving along with movement of the drawer support portion between the raised position and the lowered position.

9. The image forming apparatus as claimed in claim 6, wherein the drawer support portion has a guide groove, and wherein the conveying linkage further has a body portion, the body portion having a protruding portion guided by the guide groove so that the conveying linkage is slidably movable relative to the drawer support portion.

10. The image forming apparatus as claimed in claim 6, wherein the conveying linkage has an insertion portion, the insertion portion being configured to be inserted into the waste toner container.

11. An image forming apparatus configured to form an image on a photosensitive body by using toner accommodated in a cartridge, the image forming apparatus comprising:

a main casing;

a belt unit including a belt and a belt cleaning unit configured to collect waste toner adhered to the belt;

a waste toner container configured to store the waste toner collected by the belt cleaning unit;

a conveying unit configured to be coupled to the waste toner container and to convey the waste toner collected by the belt cleaning unit from the belt cleaning unit to the waste toner container; and a drawer frame configured to support the cartridge and the waste toner container, the drawer frame being configured to move between an internal position where the drawer frame is inside the main casing and an external position where the drawer frame is at least partly outside the main casing, the drawer frame moving from the internal position to the external position in a moving direction, the drawer frame in the internal position being configured to move between a contact position where the photosensitive body is in contact with the belt and a separated position where the photosensitive body is spaced apart from the belt, wherein the conveying unit is configured to be moved along with movement of the drawer frame between the contact position and the separated position, the conveying unit being configured to be uncoupled from the waste toner container while the drawer frame moves from the internal position to the external position, wherein the photosensitive body includes a plurality of photosensitive members, the plurality of photosensitive members being arranged juxtaposed with each other in the moving direction and including a first photosensitive member disposed most upstream of the photosensitive members in the moving direction, and wherein the waste toner container is disposed adjacent to the first photosensitive member.

12. The image forming apparatus as claimed in claim 11, wherein the conveying unit is coupled to the waste toner container while the drawer frame is in the internal position, the conveying unit being further configured to move between a first position and a second position while remaining coupled to the waste toner container, the conveying unit being placed in the first position when the drawer frame is in the contact position and being placed in the second position when the drawer frame is in the separated position.

13. The image forming apparatus as claimed in claim 12, wherein the conveying unit is configured to pivotally move between the first position and the second position.

14. The image forming apparatus as claimed in claim 11, wherein the main casing is formed with an opening through which the drawer frame moves between the internal position and the external position, and wherein the main casing includes:

a movable member configured to move between an open position for exposing the opening and a closed position for covering the opening; and an interlocking mechanism configured to move the drawer frame from the contact position to the separated position in response to movement of the movable member from the closed position to the open position and configured to move the drawer frame from the separated position to the contact position in response to movement of the movable member from the open position to the closed position.

15. The image forming apparatus as claimed in claim 11, wherein the belt cleaning unit is disposed upstream of the waste toner container in the moving direction.

16. The image forming apparatus as claimed in claim 11, further comprising a drawer support portion supporting the drawer frame when the drawer frame is in the internal position.

17. The image forming apparatus as claimed in claim 16, wherein the drawer support portion is configured to move between a raised position and a lowered position, the drawer frame being placed in the separated position when the drawer support portion is in the raised position, the drawer frame being placed in the contact position when the drawer support portion is in the lowered position.

18. The image forming apparatus as claimed in claim 17, wherein the conveying unit has a conveying linkage and a conveying pipe, the conveying linkage having a discharge hole configured to communicate with the waste toner container, and the conveying pipe being rotatably fitted with the belt cleaning unit and the conveying linkage, and wherein the drawer support portion supports the conveying linkage, the conveying linkage moving along with movement of the drawer support portion between the raised position and the lowered position.

19. The image forming apparatus as claimed in claim 18, wherein the drawer support portion has a guide groove, and wherein the conveying linkage has an insertion portion and a body portion, the insertion portion being configured to be inserted into the waste toner container, and the body portion having a protruding portion guided by the guide groove so that the conveying linkage is slidably movable relative to the drawer support portion.

* * * * *